US008695375B2

(12) United States Patent
Kirkwood

(10) Patent No.: US 8,695,375 B2
(45) Date of Patent: Apr. 15, 2014

(54) MICROCHANNEL HEAT EXCHANGER INCLUDING MULTIPLE FLUID CIRCUITS

(75) Inventor: Allen C. Kirkwood, Brownsburg, IN (US)

(73) Assignee: Carrier Corporation, Farmington, CT (US)

( * ) Notice: Subject to any disclaimer, the term of this patent is extended or adjusted under 35 U.S.C. 154(b) by 726 days.

(21) Appl. No.: 12/921,432

(22) PCT Filed: Apr. 13, 2009

(86) PCT No.: PCT/US2009/040313

§ 371 (c)(1), (2), (4) Date: Sep. 8, 2010

(87) PCT Pub. No.: WO2009/137226

PCT Pub. Date: Nov. 12, 2009

(65) Prior Publication Data

US 2011/0030420 A1 Feb. 10, 2011

Related U.S. Application Data

(60) Provisional application No. 61/050,387, filed on May 5, 2008.

(51) Int. Cl.
*F25B 39/02* (2006.01)

(52) U.S. Cl.
USPC ..... 62/525; 62/526

(58) Field of Classification Search
USPC ..... 62/525, 515, 524, 526, 434, 498
See application file for complete search history.

(56) References Cited

U.S. PATENT DOCUMENTS

| | | | | |
|---|---|---|---|---|
| 4,256,475 | A | 3/1981 | Schafer | |
| 4,932,467 | A | 6/1990 | Wigmore et al. | |
| 5,622,057 | A | 4/1997 | Bussjager et al. | |
| 5,967,228 | A | 10/1999 | Bergman et al. | |
| 5,979,547 | A * | 11/1999 | Shinmura et al. | 165/174 |
| 6,820,434 | B1 | 11/2004 | Gutheim et al. | |
| 6,973,804 | B2 | 12/2005 | Horiuchi et al. | |
| 7,272,948 | B2 | 9/2007 | Taras et al. | |
| 2003/0192340 | A1 * | 10/2003 | DiFlora | 62/525 |
| 2004/0154331 | A1 | 8/2004 | Horiuchi et al. | |
| 2004/0168467 | A1 * | 9/2004 | Nuiding | 62/525 |
| 2005/0086965 | A1 * | 4/2005 | Lalumiere et al. | 62/277 |
| 2005/0132744 | A1 * | 6/2005 | Rohrer et al. | 62/515 |
| 2006/0101849 | A1 * | 5/2006 | Taras et al. | 62/515 |
| 2007/0101761 | A1 * | 5/2007 | Yanik et al. | 62/515 |
| 2007/0169924 | A1 | 7/2007 | Bussonnet | |

FOREIGN PATENT DOCUMENTS

| | | |
|---|---|---|
| KR | 10-1999-0085965 | 12/1999 |
| KR | 10-2004-0052331 | 6/2004 |
| KR | 10-0610507 B | 8/2006 |
| KR | 10-2007-0100105 | 10/2007 |

OTHER PUBLICATIONS

Search Report and Written Opinion mailed on Nov. 24, 2009 for PCT/US2009/040313.

International Preliminary Report on Patentability mailed on Nov. 18, 2010 for PCT/US2009/040313.

* cited by examiner

*Primary Examiner* — Mohammad M Ali

(74) *Attorney, Agent, or Firm* — Carlson, Gaskey & Olds, PC

(57) ABSTRACT

A microchannel heat exchanger includes a plurality of microchannel tubes including a first set of microchannel tubes and a second set of microchannel tubes. A first circuit of the microchannel heat exchanger includes the first set of microchannel tubes, and a portion of a first fluid flows through the first set of microchannel tubes and exchanges heat with a second fluid. A second circuit of the microchannel heat exchanger includes the second set of microchannel tubes, and a reminder of the first fluid flows through the second set of microchannel tubes and exchanges heat with the second fluid. The first fluid from the first circuit and the first fluid from the second circuit combine into a common flow.

8 Claims, 2 Drawing Sheets

MICROCHANNEL HEAT EXCHANGER INCLUDING MULTIPLE FLUID CIRCUITS

RELATED APPLICATION

This application claims priority to U.S. Provisional Patent Application No. 61/050,387, which was filed May 5, 2008.

This application is a United States National Phase application of PCT application Ser. No. PCT/US2009/040313 filed Apr. 13, 2009.

BACKGROUND OF THE INVENTION

This invention relates generally to a microchannel heat exchanger including multiple fluid circuits.

A microchannel heat exchanger (MCHX) exchanges heat between a refrigerant and a fluid, such as air. The microchannel heat exchanger includes a plurality of microchannel tubes. The refrigerant flows through the plurality of microchannel tubes, and the air flows over the plurality of microchannel tubes.

The microchannel heat exchanger utilizes a single refrigerant circuit. The refrigerant enters the circuit through an inlet and can make multiple passes through the microchannel heat exchanger. The refrigerant then exits the circuit through an outlet. This results in a high refrigerant side pressure drop for a given amount of refrigerant side heat transfer. This adverse relationship affects the overall system performance, particularly at high outdoor ambient conditions, which causes the discharge pressure to be higher than a comparable round tube plate fin (RTPF) heat exchanger.

SUMMARY OF THE INVENTION

A microchannel heat exchanger includes a plurality of microchannel tubes including a first set of microchannel tubes and a second set of microchannel tubes. A first circuit of the microchannel heat exchanger includes the first set of microchannel tubes, and a portion of a first fluid flows through the first set of microchannel tubes and exchanges heat with a second fluid. A second circuit of the microchannel heat exchanger includes the second set of microchannel tubes, and a reminder of the first fluid flows through the second set of microchannel tubes and exchanges heat with the second fluid. The first fluid from the first circuit and the first fluid from the second circuit combine into a common flow.

In another example, a refrigeration system includes a compressor for compressing a refrigerant, a condenser for cooling the refrigerant, an expansion device for expanding the refrigerant, and an evaporator for heating the refrigerant. One of the condenser and the evaporator is a microchannel heat exchanger. The microchannel heat exchanger includes a plurality of microchannel tubes including a first set of microchannel tubes and a second set of microchannel tubes. A first circuit of the microchannel heat exchanger includes the first set of microchannel tubes, and a portion of the refrigerant flows through the first set of microchannel tubes and exchanges heat with air. A second circuit of the microchannel heat exchanger includes the second set of microchannel tubes, and a reminder of the refrigerant flows through the second set of microchannel tubes and exchanges heat with the air. The refrigerant from the first circuit and the refrigerant from the second circuit combine into a common flow.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
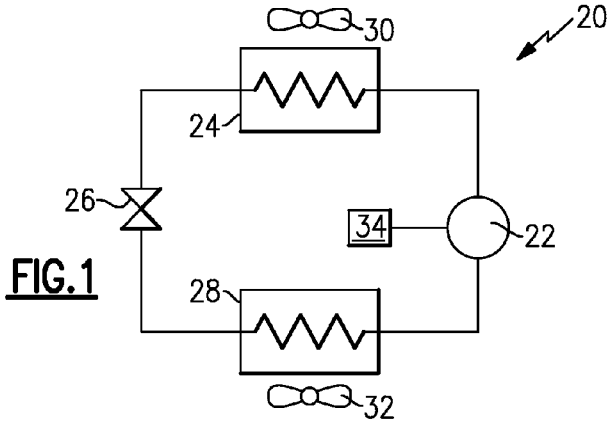
FIG. 1 illustrates a prior art refrigeration system.

FIG. 1 illustrates a refrigeration system 20 including a compressor 22, a first heat exchanger 24, an expansion device 26, and a second heat exchanger 28. Refrigerant circulates through the closed circuit refrigeration system 20.

When the refrigeration system 20 is operating in a cooling mode, the refrigerant exits the compressor 22 at a high pressure and a high enthalpy and flows through the first heat exchanger 24, which acts as a condenser. In the first heat exchanger 24, the refrigerant rejects heat to air and is condensed into a liquid that exits the first heat exchanger 24 at a low enthalpy and a high pressure. A fan 30 directs the air through the first heat exchanger 24. The cooled refrigerant then passes through the expansion device 26, expanding the refrigerant to a low pressure. After expansion, the refrigerant flows through the second heat exchanger 28, which acts as an evaporator. In the second heat exchanger 28, the refrigerant accepts heat from air, exiting the second heat exchanger 28 at a high enthalpy and a low pressure. A fan 32 blows air through the second heat exchanger 28. The refrigerant then flows to the compressor 22, completing the cycle.

When the refrigeration system 20 is operating in a heating mode, the flow of the refrigerant is reversed with a four-way valve 34. The first heat exchanger 24 accepts heat from the air and functions as an evaporator, and the second heat exchanger 28 rejects heat to the air and functions as a condenser. For ease of reference, the microchannel heat exchanger can be referred to as a microchannel heat exchanger 38 and is shown in further detail in FIG. 2.

Either or both of the heat exchangers 24 and 28 can be the microchannel heat exchanger 38. The microchannel heat exchanger 38 can be part of a refrigeration system 20 used with a microdevice, an automobile air conditioner or a residential system.

Figure 2:
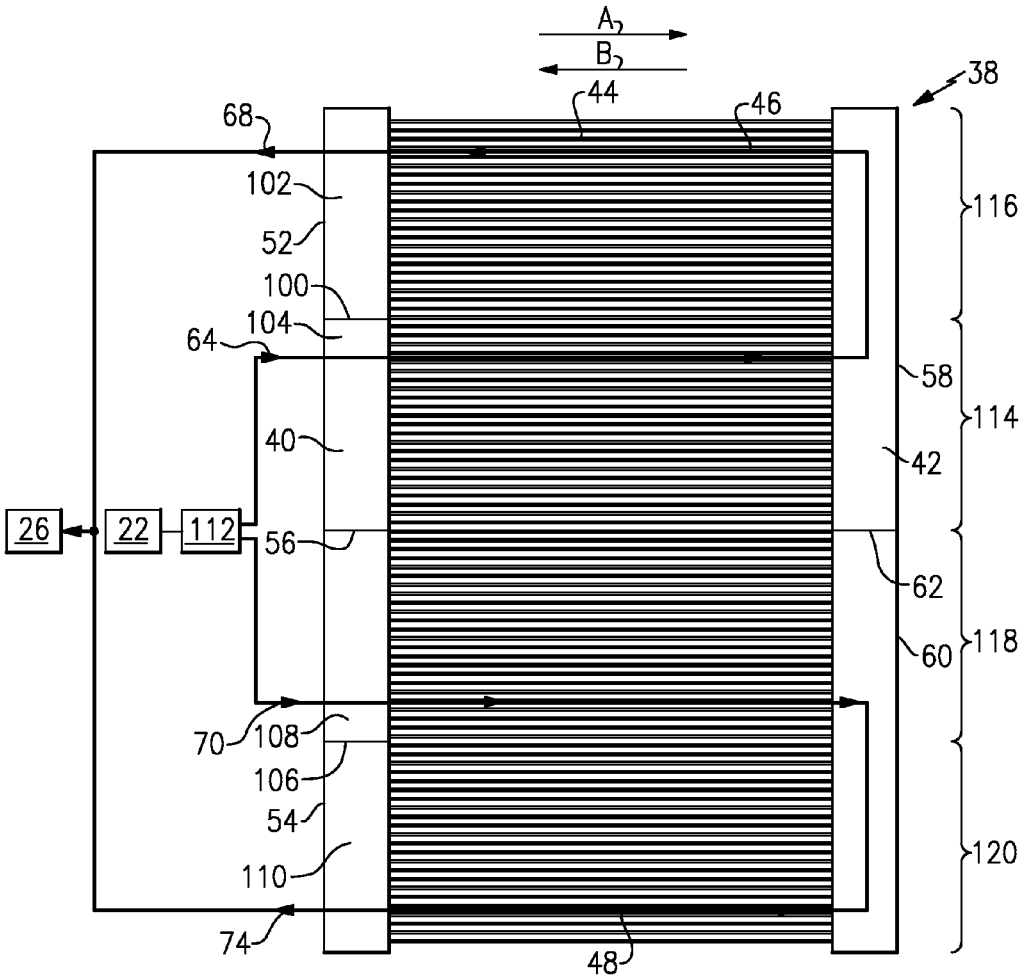
FIG. 2 illustrates a multiple circuit microchannel heat exchanger.

FIG. 2 illustrates a first example microchannel heat exchanger 38. The microchannel heat exchanger 38 includes an entry/exit header 40, a return header 42, and microchannel tubes 44 that extend between the headers 40 and 42. The microchannel tubes 44 are substantially parallel. Each microchannel tube 44 is a flat multi-port tube, and each port has a hydraulic diameter of less than 1 mm.

The microchannel heat exchanger 38 includes multiple independent and separate refrigerant sections or circuits. In one example, the microchannel heat exchanger 38 includes a first circuit 46 and a second circuit 48 that are separate from each other. In the below described example, the refrigerant makes two passes through each refrigerant circuit 46 and 48. However, the refrigerant can make any number of passes through each refrigerant circuit 46 and 48. For example, the refrigerant can make only one pass or can make more than two passes through the microchannel heat exchanger 38. A pass is defined as one trip through the microchannel tubes 44 between the headers 40 and 42. Therefore, the refrigerant makes two passes through the microchannel tubes 44 to complete a circuit.

In one example, the microchannel heat exchanger 38 is a condenser, and a distributor 112 splits the refrigerant from the compressor 22 into two paths. One path of the refrigerant flows through a coil of the first circuit 46, and one path of refrigerant flows through a coil of the second circuit 48. In one example, the refrigerant is split equally between the two circuits 46 and 48.

A divider wall 56 splits the entry/exit header 40 into a first entry/exit section 52 and a second entry/exit section 54, preventing refrigerant flow between the sections 52 and 54. A divider wall 100 separates the first entry/exit section 52 into a first entry section 104 and a first exit section 102. A divider wall 106 separates the second entry/exit section 54 into a second entry section 108 and a second exit section 110. A divider wall 62 splits the return header 42 into a first return section 58 and a second return section 60, preventing refrigerant flow between the sections 58 and 60.

The refrigerant enters the first circuit 46 through an inlet 64. In one example, the refrigerant in the first entry section 104 of the first entry/exit section 52 of the entry/exit header 40 flows through a group 114 of microchannel tubes 44 in a direction A, rejecting heat to the air flowing over the microchannel tubes 44. The refrigerant then flows into the first return section 58 of the return header 42. The refrigerant flow then turns 180° in the first return section 58 and flows back into another group 116 of microchannel tubes 44 in an opposing second direction B, rejecting additional heat to the air flowing over the microchannel tubes 44. This pattern is repeated for additional passes. The refrigerant then enters the first exit section 102 of the first entry/exit section 52 of the entry/exit header 40 and exits the first circuit 46 through an outlet 68. The groups 114 and 116 of microchannel tubes 44 are exclusive to the first circuit 46.

In another example, the refrigerant enters the first circuit 46 through the first exit section 102 and exits the first circuit 46 through the first entry section 104.

The refrigerant enters the second circuit 48 through an inlet 70. The refrigerant in the second entry section 108 of the second entry/exit section 54 of the entry/exit header 40 flows through a group 118 of microchannel tubes 44 in a direction A, rejecting heat to the air flowing over the microchannel tubes 44. The refrigerant then flows into the second return section 60 of the return header 42. The refrigerant flow then turns 180° in the second return section 60 and flows back into another group 120 of microchannel tubes 44 in an opposing second direction B, rejecting additional heat to the air flowing over the microchannel tubes 44. This pattern is repeated for additional passes. The refrigerant then enters the second exit section 110 of the second entry/exit section 54 of the entry/exit header 40 and exits the second circuit 48 through an outlet 74. The groups 118 and 120 of microchannel tubes 44 are exclusive to the second circuit 48.

In another example, the refrigerant enters the second circuit 48 through the second exit section 110 and exits the second circuit 48 through the second entry section 108.

The refrigerant from the outlets 68 and 74 are combined into a single flow path and then directed to the expansion device 26.

Although two refrigerant circuits 46 and 48 each including two passes through the microchannel tubes 44 are illustrated and described, it is to be understood that the microchannel heat exchanger 38 can include any number of circuits, and the refrigerant in each circuit can make any number of passes through the microchannel heat exchanger 38.

Additionally, the microchannel heat exchanger 38 can be an evaporator, and the refrigerant from the expansion device 26 is split into multiple circuits and accepts heat from the air passing over the microchannel tubes 44 before flowing to the compressor 22

By employing multiple refrigerant circuits in the microchannel heat exchanger 38, the mass flow of the refrigerant is divided equally between the multiple circuits, decreasing the refrigerant side pressure drop of the refrigerant and improving refrigerant side heat transfer. The refrigerant side heat transfer can be further raised by optimally selecting the number of passes and the number of microchannel tubes 44 for each pass within each circuit. This helps to reduce the refrigerant side pressure drop, as well as reduce the charge sensitivity of the microchannel heat exchanger 38.

Figure 3:
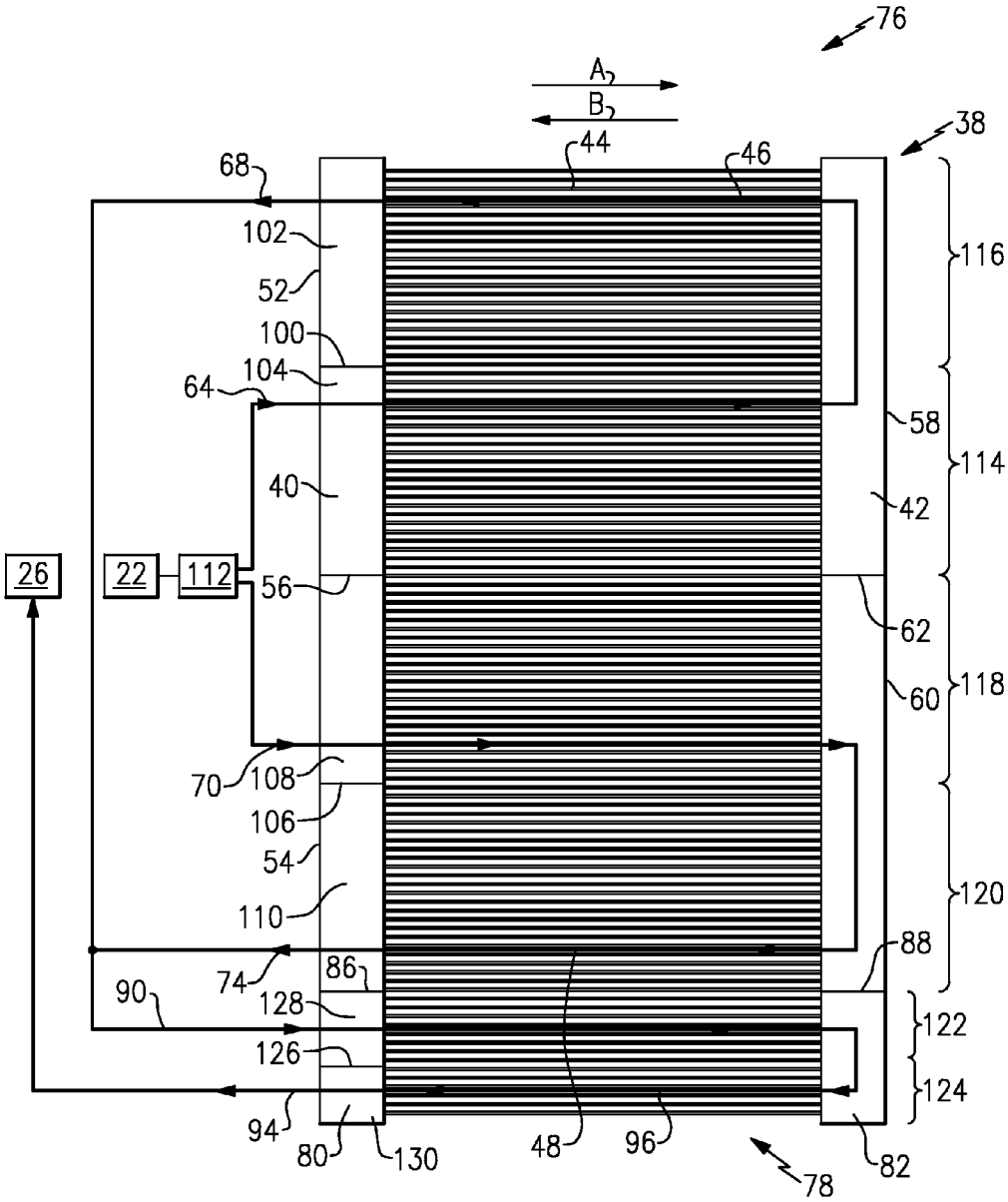
FIG. 3 illustrates a multiple circuit microchannel heat exchanger including a subcooler.

FIG. 3 illustrates a second example microchannel heat exchanger 76. The microchannel heat exchanger 76 includes the features of the microchannel heat exchanger 38 of FIG. 2 and a subcooler 78 (a third circuit). In the example illustrated and described, the microchannel heat exchanger 76 is a condenser. However, the microchannel heat exchanger 76 can be an evaporator.

The subcooler 78 is formed by a subcooler entry/exit section 80 of the entry/exit header 40, a return subcooler section 82 of the return header 42, and groups 122 and 124 of microchannel tubes 44. A divider wall 86 separates the subcooler entry/exit section 80 from the sections 52 and 54 of the entry/exit header 40 to prevent refrigerant flow between the sections 52, 54 and 80, and a divider wall 88 separates the return subcooler section 82 from the sections 58 and 60 of the return header 42 to prevent refrigerant flow between the sections 58, 60 and 82. The subcooler entry/exit section 80 is further divided by a divider wall 126 that separates the subcooler entry/exit section 80 into a subcooler entry section 128 and a subcooler exit section 130 to enable the flow to enter and leave on the same side of the microchannel heat exchanger 76.

The refrigerant exchanges heat with the air as described above with reference to FIG. 2. Refrigerant from the outlets 68 and 74 merges into a single path, and the refrigerant enters an inlet 90 of a subcooler circuit 96. Refrigerant in the subcooler entry section 128 of the subcooler entry/exit section 80 of the entry/exit header 40 flows through the group 122 of microchannel tubes 44 in a direction A, rejecting heat to the air flowing over the microchannel tubes 44. The refrigerant then enters the return subcooler section 82 of the return header 42. The refrigerant flow then turns 180° in the return subcooler section 82 and flows back into another group 124 of microchannel tubes 44 in the opposing second direction B, rejecting additional heat to the air flowing over the microchannel tubes 44. The refrigerant then enters the subcooler exit section 130 of the subcooler entry/exit section 80 of the entry/exit header 40 and exits the subcooler circuit 96 through an outlet 94. The refrigerant is then directed to the expansion device 26. The subcooler groups 122 and 124 of microchannel tubes 44 are exclusive the subcooler circuit 96.

Although the subcooler circuit 96 includes two passes in the example illustrated and described, any number of passes can be employed. For example, the refrigerant can make a single pass through the subcooler 78 or make more than two passes through the subcooler 78. By employing a subcooler 78, the heat transfer and refrigerant side pressure drop can be further optimized.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A microchannel heat exchanger comprising:

a plurality of microchannel tubes including a first set of microchannel tubes and a second set of microchannel tubes;

a first circuit including the first set of microchannel tubes, wherein a portion of a first fluid flows through the first set of microchannel tubes and exchanges heat with a second fluid;

a second circuit including the second set of microchannel tubes, wherein a remainder of the first fluid flows through the second set of microchannel tubes and exchanges heat with the second fluid, wherein the first fluid from the first circuit and the first fluid from the second circuit combine into a common flow; and the microchannel heat exchanger includes a first header, a second header, and the plurality of microchannel tubes extend therebetween, wherein the first fluid from the first circuit and the first fluid from the second circuit combine into a common flow after exiting the plurality of microchannel tubes, the first header, and the second header.

2. A refrigeration system comprising:

a compressor for compressing a refrigerant;

a condenser for cooling the refrigerant;

an expansion device for expanding the refrigerant; and an evaporator for heating the refrigerant, wherein at least one of the condenser and the evaporator is a microchannel heat exchanger, the microchannel heat exchanger including a plurality of microchannel tubes including a first set of microchannel tubes and a second set of microchannel tubes, wherein a first circuit includes the first set of tubes and a second circuit includes the second set of tubes, wherein a portion of the refrigerant flows through the first set of tubes and exchanges heat with air, a remainder of the refrigerant flows through the second set of tubes and exchanges heat with the air, and the refrigerant from the first circuit and the refrigerant from the second circuit combine into a common flow, further including a distributor, the distributor in communication with the compressor, and the distributor splitting the refrigerant from the compressor into the portion and the remainder before the portion flows through the first set of tubes and the remainder flows through the second set of tubes.

3. The refrigeration system as recited in claim 2 including a third circuit including a third set of microchannel tubes, wherein the common flow flows through the third set of microchannel tubes to exchange heat with the air.

4. The refrigeration system as recited in claim 3 including a first header, a second header, and the plurality of microchannel tubes extend therebetween, wherein the refrigerant from the first circuit and the refrigerant from the second circuit combine into the common flow after exiting the plurality of microchannel tubes, the first header, and the second header, before entering the third set of microchannel tubes, wherein a first divider wall separates each the first header and the second header into a first header section and a second header section and a second divider wall separates each of the first header and the second header into the second header section and a third header section, preventing flow of the refrigerant between the header sections, and wherein the first header section is associated with the first circuit, the second header section is associated with the second circuit, and the third header section is associated with the third circuit.

5. The refrigeration system as recited in claim 4 wherein the first header section, the second header section and the third header section of the first header each include an additional wall that separates each of the header sections into an entry section and an exit section, wherein the refrigerant enters each of the circuits through the entry section and exits each of the circuits through the exit section.

6. The refrigeration system as recited in claim 3 wherein the refrigerant makes two passes through the plurality of microchannel tubes, wherein the portion of the refrigerant flows through a group of the first set of microchannel tubes in a first direction and then flows through another group of the first set of microchannel tubes in an opposing second direction, wherein the remainder of the refrigerant flows through a group of the second set of microchannel tubes in the first direction and then flows through another group of the second set of microchannel tubes in the opposing second direction, and wherein the common flow of the refrigerant flows through a group of the third set of microchannel tubes in the first direction and then flows through another group of the third set of microchannel tubes in the opposing second direction.

7. The refrigeration system as recited in claim 3 wherein the first circuit, the second circuit and the third circuit are separate.

8. The refrigeration system as recited in claim 2, wherein the microchannel heat exchanger includes a first header, a second header, and the plurality of microchannel tubes extend therebetween, wherein the refrigerant from the first circuit and the refrigerant from the second circuit combine into a common flow after exiting the plurality of microchannel tubes, the first header, and the second header.

* * * * *